United States Patent [19]

Ishii

[11] Patent Number: 4,476,766

[45] Date of Patent: Oct. 16, 1984

[54] ELECTRONIC MUSICAL INSTRUMENT WITH MEANS FOR GENERATING ACCOMPANIMENT AND MELODY SOUNDS WITH DIFFERENT TONE COLORS

[75] Inventor: Hiroshi Ishii, Tokyo, Japan

[73] Assignee: Casio Computer Co., Ltd., Tokyo, Japan

[21] Appl. No.: 568,283

[22] Filed: Jan. 5, 1984

Related U.S. Application Data

[63] Continuation of Ser. No. 445,428, Nov. 30, 1982, abandoned, which is a continuation of Ser. No. 231,133, Feb. 3, 1981, abandoned.

[30] Foreign Application Priority Data

Feb. 4, 1980 [JP] Japan ..... 55-12193

[51] Int. Cl.[3] ..... G10H 1/06; G10H 1/36; G10H 7/00

[52] U.S. Cl. ..... 84/1.03; 84/1.17; 84/1.19; 84/1.28

[58] Field of Search ..... 84/1.01, 1.03, 1.11–1.13, 84/1.17, 1.19–1.21, 1.24, 1.28, DIG. 12, DIG. 22

[56] References Cited

U.S. PATENT DOCUMENTS

| | | | |
|---|---|---|---|
| 3,935,781 | 2/1976 | Katoh et al. | 84/1.11 |
| 4,022,097 | 5/1977 | Strangio | 84/1.03 |
| 4,114,495 | 9/1978 | Tomisawa | 84/1.01 |
| 4,176,577 | 12/1979 | Yamada et al. | 84/1.01 |
| 4,192,211 | 3/1980 | Yamaga et al. | 84/1.01 |
| 4,213,366 | 7/1980 | Niimi et al. | 84/1.01 |
| 4,245,542 | 1/1981 | Woron | 84/1.19 X |
| 4,283,983 | 8/1981 | Kashio | 84/1.19 |
| 4,287,802 | 9/1981 | Imamura et al. | 84/1.01 |
| 4,326,442 | 4/1982 | Suzuki | 84/1.19 |
| 4,365,532 | 12/1982 | Nakada et al. | 84/1.19 |

FOREIGN PATENT DOCUMENTS

| | | |
|---|---|---|
| 1564822 | 4/1980 | United Kingdom . |
| 1566663 | 5/1980 | United Kingdom . |

*Primary Examiner*—S. J. Witkowski

*Attorney, Agent, or Firm*—Frishauf, Holtz, Goodman and Woodward

[57] ABSTRACT

Predetermined performance keys in a group for a low octave section are used as read-out keys for reading out accompaniment memorized in a first memory, and the other keys in the keyboard are used as read-out keys for reading out melody memorized in a second memory. The read-out accompaniment and melody contents are reproduced with a first tone color designated by a first tone color designation switch given to the accompaniment and a second tone color designated by a second tone color designation switch given to the melody.

16 Claims, 7 Drawing Figures

MEMORY SECTION
30
31
31h
31g
31f
31e
31a
31b
31c
31d
MEMORY
INC
R/W
32
32h
32g
32f
32e
32a
32b
32c
32d
MEMORY
INC
R/W
40
A B C D E F G
CONTROL SECTION
5a
5b
5c
+V
φA

ELECTRONIC MUSICAL INSTRUMENT WITH MEANS FOR GENERATING ACCOMPANIMENT AND MELODY SOUNDS WITH DIFFERENT TONE COLORS

This application is a continuation, of application Ser. No. 445,428, filed Nov. 30, 1982, now abandoned, which is a continuation of Ser. No. 231,133 filed Feb. 3, 1981, now abandoned.

BACKGROUND OF THE INVENTION

This invention relates to electronic keyboard musical instruments, in which note codes of a memorized piece of music are read out with the operation of the keyboard for reproduction of memorized music sounds with particular sound colors provided for the respective note code read-out key groups.

In playing electronic keyboard musical instruments, it is usual to use the right hand for performing melody and the left hand for performing the accompaniment. However, the melody and accompaniment of a music piece often have different rhythms, and the performance of such a piece is very difficult for beginners.

Accordingly, it has been in practice to previously memorize the accompaniment, for instance, and perform the melody part of the piece to automatic reproduction of the memorized accompaniment. Conversely, it is thought to memorize the melody and perform for accompaniment while reproducing the memorized melody.

However, with the prior-art electronic keyboard musical instrument usually only a single sound color is provided for the reproduced music sound. Therefore, the reproduced music sound is rather monotonous in regard to the sound effect. Also, even where a sound color select switch is provided, such a select switch is disposed outside the keyboard and is thus considerably inconvenient to operate for changing sound colors during the performance. Thus, the operation control property of the instrument provided with such a sound color select switch is inferior and only inferior sound effects could be provided.

An object of the invention is to provide an electronic keyboard musical instrument, which has good operation control properties and can permit performance with high quality of musical sound effects, and in which different sound colors for music sound reproduction are assigned to a plurality of groups of keys used as read-out instruction keys in the reproduction of memorized musical performance content in a memory section.

SUMMARY OF THE INVENTION

According to the invention, there is provided an electronic keyboard musical instrument comprising a keyboard having a plurality of performance keys, memory means for memorizing successive musical tone codes, function setting means for setting performance keys of the keyboard in a plurality of groups as tone code read-out keys for reading out tone codes memorized in the memory means, and tone color setting means for setting different colors of reproduced musical sounds for the respective tone code read-out key groups.

DETAILED DESCRIPTION

Figure 1:
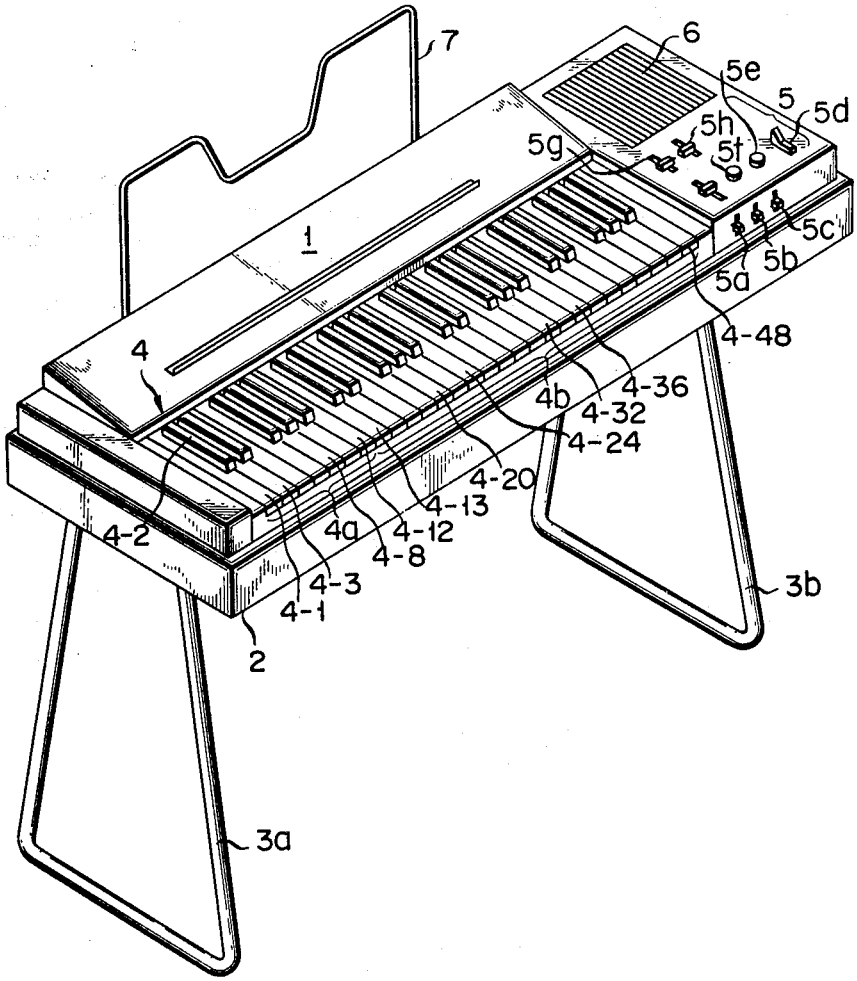
FIG. 1 is a perspective view showing an embodiment of the electronic keyboard musical instrument according to the invention.

Referring now to FIG. 1, an electronic keyboard musical instrument, generally designated at 1, comprises an instrument body 2 and support legs 3*a* and 3*b*. The instrument body 2 has a keyboard section 4, an operation section 5, a loudspeaker 6 and a music stand 7. The keyboard section 4 has 48 performance keys 4-1, 4-2, . . . , 4-28 for four octaves, with the key 4-1 set to the pitch $C_2$ and the key 4-48 set to the pitch $B_5$. As will be described hereinafter in detail, the lowest octave keys 4-1 to 4-12 for the respective pitches $C_2$ to $B_2$ among the performance keys are classed as first group keys 4*a* when function selection switches 5*a* to 5*c* provided in the operation section 5 are operated. At this time, the other keys 4-13 to 4-48 for the pitches $C_3$ to $C_5$ in the remaining three octaves are classed as second group keys 4*b*.

In the operation section 5, a power switch 5*d*, a volume control knob 5*e*, a tone switch 5*f* and tone color designation switches 5*g* and 5*h* are provided in addition to the function selection switches 5*a* to 5*c*. The function selection switches 5*a* to 5*c* are operated to select either an ordinary performance state of the keyboard 4 or a state with the keys functionally divided into the groups 4*a* and 4*b* for read-out or a state for writing the performance content in one of first and second memories. This will be described hereinafter in detail. The tone color designation switches 5*g* and 5*h* are operated to designate various sound colors such as flute sound, piano sound, guitar sound and violin sound.

Figure 2A:
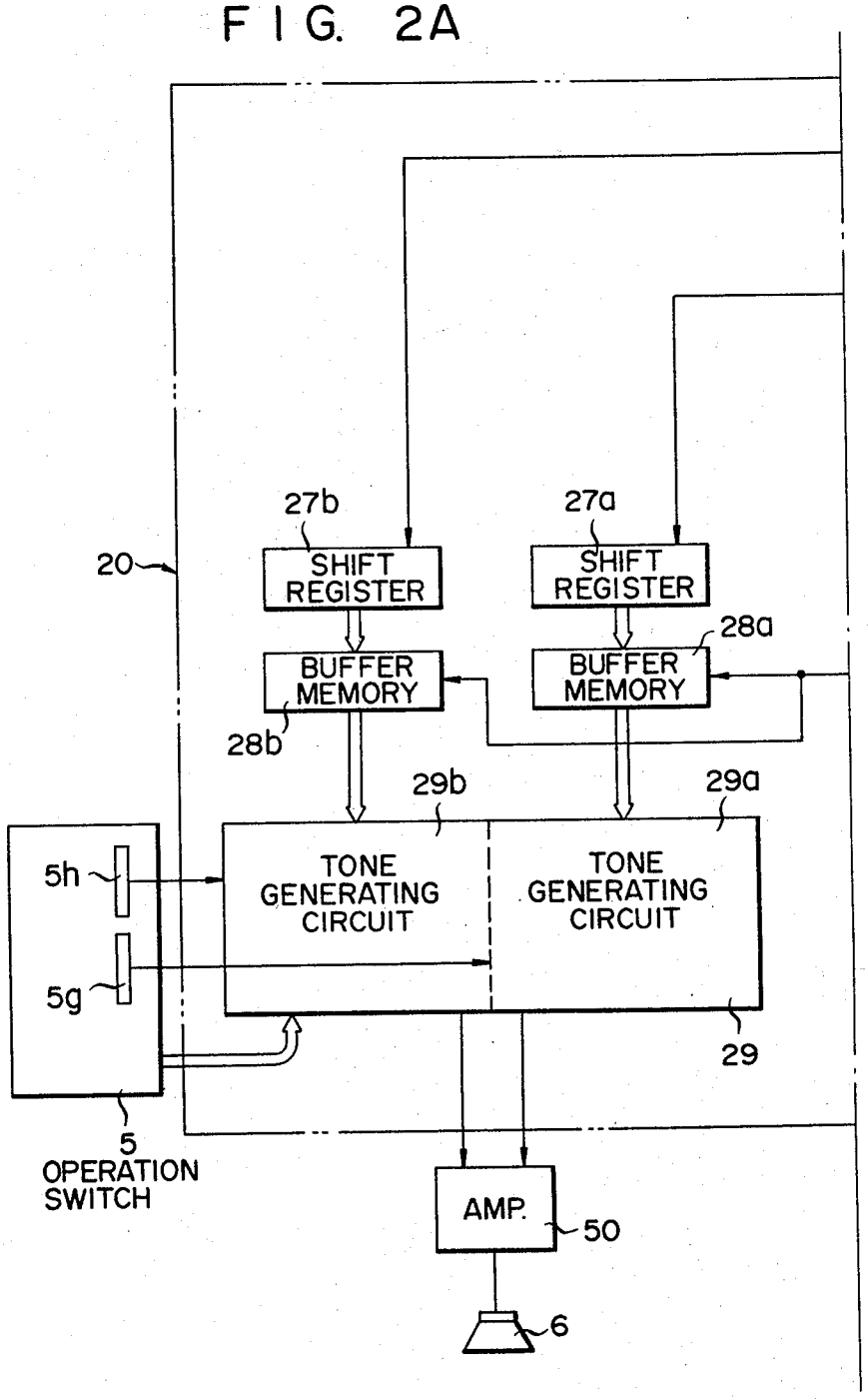
FIGS. 2A, 2B and 2C show a circuit diagram, partly in block form, of the same embodiment.
Figure 2B:
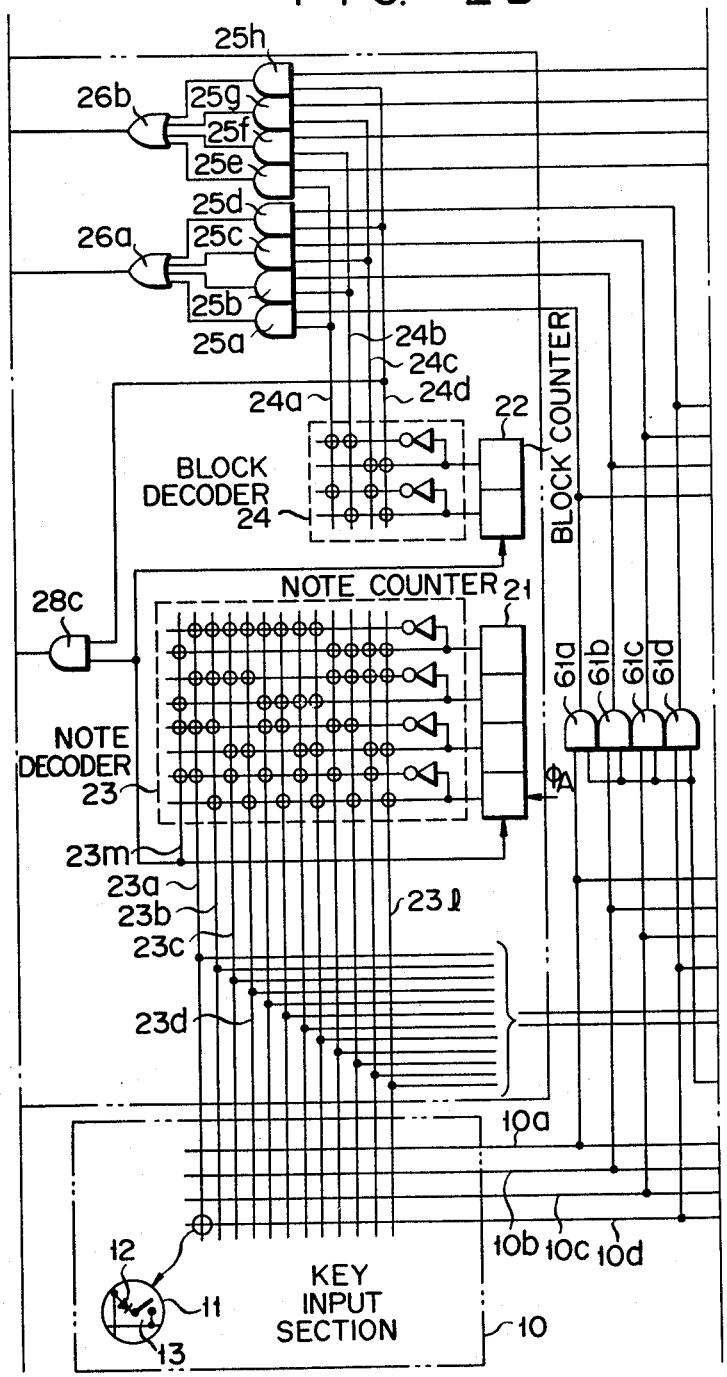
Figure 2C:
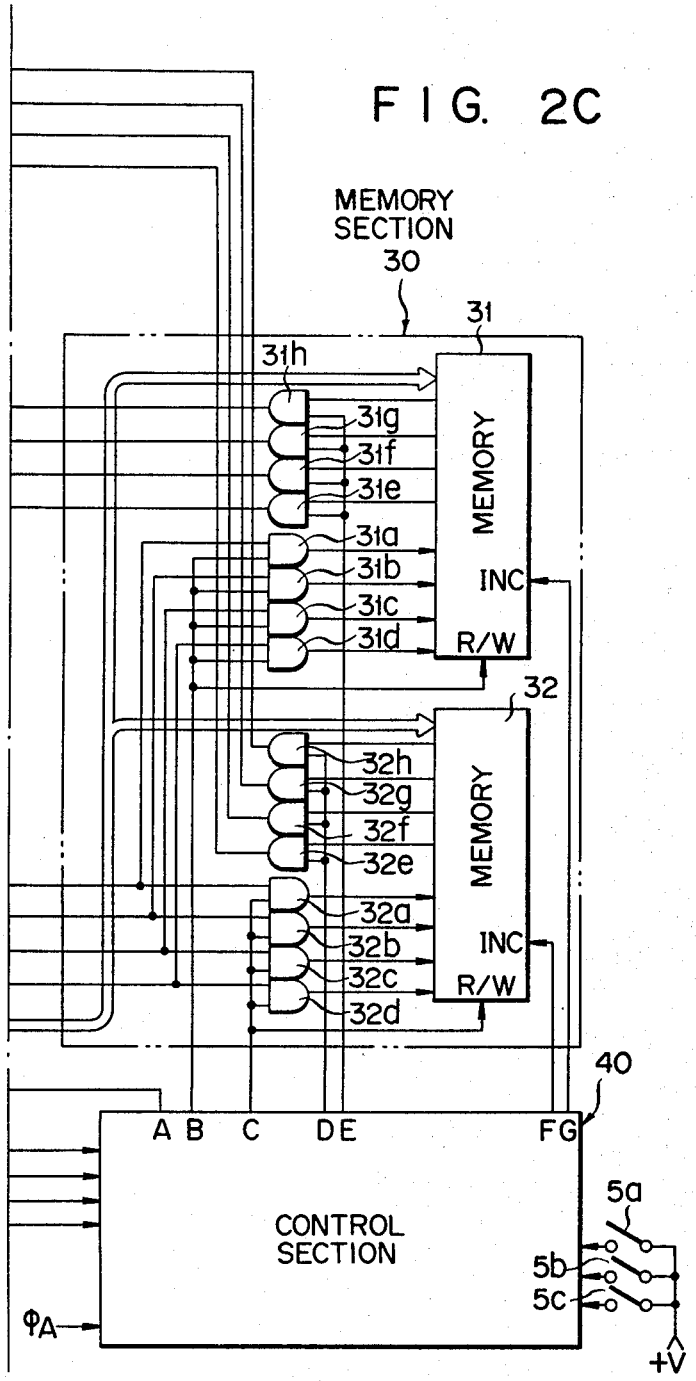

FIGS. 2A, 2B and 2C show the circuit construction of this embodiment. This circuit consists of five circuit blocks and wiring leads connecting these blocks to one another. These circuit blocks each consist of an LSI (large scale integrated circuit) or a hybrid IC. The circuit block 10 is a key input section which is operated by each of the keys in the keyboard section 4, the circuit block 20 is a tone generating section including tone generating circuits and circuits for controlling key inputs, the circuit block 30 is a memory section including first and second memories 31 and 32 in which scale codes are preset as well as peripheral circuits, the circuit block 40 is a control section for feeding control signals to the memory section 30 and other parts of the circuit, and the circuit block 50 is an amplifier for feeding musical tone signal to the loudspeaker 6. The memories 31 and 32 are semiconductor memories; for example, they are constituted by random access memories (RAM).

Now, the circuit blocks 10 to 50 and their connection will be described. The tone generating section 20 includes a 4-bit note counter 21 for scanning the keyboard 4 to detect a depressed key and a 2-bit block counter 22. A clock signal $\phi_A$ for scanning is supplied to the first bit of the note counter 21. The count content of the note counter 21 is coupled to a note decoder 23, which scans like note keys of the corresponding tone names in the individual octaves of the key input section 10 by producing a "1" signal at different timings to twelve lines 23*a* to 23*l* or respective twelve tones C to B according to the count values "0" to "11" of the note counter 21. The note decoder 23 also has a line 23*m*, in which an output is obtained when the count value of the note counter 21 becomes "12", and this output is coupled as a rest signal to the note counter 21 and also coupled as a count clock signal to the block counter 22. The block counter 22 counts the count signal mentioned above, and its count content is coupled to a block decoder 24. The block decoder 24 supplies different timing signals to lines 24*a* to 24*d* according to the count values "0" to "3" of the block counter 22, and the signals supplied to these lines 24*a* to 24*d* are coupled as octave signals to AND gates 25*a* to 25*d* at one input terminal thereof and also to AND gates 25*e* to 25*h* at one input terminal thereof. The outputs of the AND gates 25*a* to 25*d* are coupled through an OR gate 26*a* to a shift register 27*a*, which has a function of serial-to-parallel conversion and also has a capacity of 48 bits corresponding to the number of keys in the key input section 10, and the outputs of the AND gates 25*e* to 25*h* are coupled through an OR gate 26*b* to a similar shift register 27*b*. The shift registers 27*a* and 27*b* each have bit positions peculiar to the respective keys in the key input section 10 and memorize data with respect to depressed keys of these keys, and their parallel outputs are coupled to respective buffer memories 28*a* and 28*b* individually having the same 48-bit capacity as the shift registers 27*a* and 27*b*. The buffer memories 28*a* and 28*b* store the contents of the shift registers 27*a* and 27*b* when the scanning of all the keys in the key input section 10 is ended in response to a read signal, which is the output of an AND gate 28*c* to which the signals from the line 23*m* of the note decoder 23 and the line 24*d* of the block decoder 24 are coupled. The outputs of the buffer memories 28*a* and 28*b* are coupled to respective tone generating circuits 29*a* and 29*b*, collectively designated at 29, in which various tone signals are produced as digital signals according to the pitches of operated keys. These tone generating circuits 29*a* and 29*b* produce tone signals in different systems respectively according to the signals from the buffer memories 28*a* and 28*b*. The tone color of the musical tones produced according to the tone signals from the circuits 29*a* and 29*b* are selected by operating the tone color designation switches 5*g* and 5*h*. Alternatively, a single tone generator circuit may be driven on a time division basis to produce tone signals in the two systems. The digital tone signals produced within the tone generating circuits 29*a* and 29*b* are converted into analog signals by digital-to-analog converters within the circuits 29*a* and 29*b*. The digital tone signal produced from the tone signal generator circuit 29 is supplied from a digital-to-analog converter provided in the circuit 29, and this analog output signal is amplified through the amplifier 50, the output of which is coupled to the loudspeaker 6 for producing a music sound. The output produced from the operation section 5 according to operation thereof is coupled to the generating circuit 29, and this circuit 29 produces tone signals according to the output of the buffer memories 28*a* and 28*b* and outputs of the operation section 5.

The key input section 10 has a matrix constituted by four row lines and twelve column lines with 48 switches corresponding to the respective keys for 4 octaves in the keyboard 4 and each provided at each intersection of the matrix. A typical intersection is shown in detail within a circle 11. As is shown, a diode 12 and a switch 13 coupled to a performance key are connected in the illustrated manner. The individual column lines in the key input section 10 are connected to the respective lines 23*a* to 23*l* of the note decoder 23. Like keys for different octaves are connected in the individual columns, and keys for respective 12 pitches C to B in the respective octaves are connected in each row. Key operation outputs from the individual row lines are coupled to respective lines 10*a* to 10*d* at the timings of the individual tone names in each row.

The key operation signals coupled to the lines 10*a* to 10*d* are coupled to respective AND gates 61*a* to 61*d* at one input terminal thereof, and the outputs thereof are coupled to the other input terminals of the respective AND gates 25*a* to 25*d*.

The key operation signals coupled to the lines 10*a* to 10*d* are also coupled through respective AND gates 31*a* to 31*d* to a first memory 31 in the memory section 30 and also through respective AND gates 32*a* to 32*d* to a second memory 32 in the section. To these memories 31 and 32 note codes that are output to the lines 23*a* to 23*l* are also coupled.

Data read out from the first and second memories 31 and 32 are coupled through respective AND gates 31*e* to 31*h* and 32*e* to 32*h* to the other input terminals of the respective AND gates 25*a* to 25*d* and 25*e* to 25*h*. The AND gates 31*a* to 31*d*, 32*a* to 32*d*, 31*e* to 31*h* and 32*e* to 32*h* are on-off controlled by control signals B, C, E and D coupled to their other input terminals from the control section 40. The control section 40 also supplies the signals B and C as write/read (W/R) control signals and address increment signals G and F to the first and second memories 31 and 32 when writing or reading data.

Figures 3, 4:
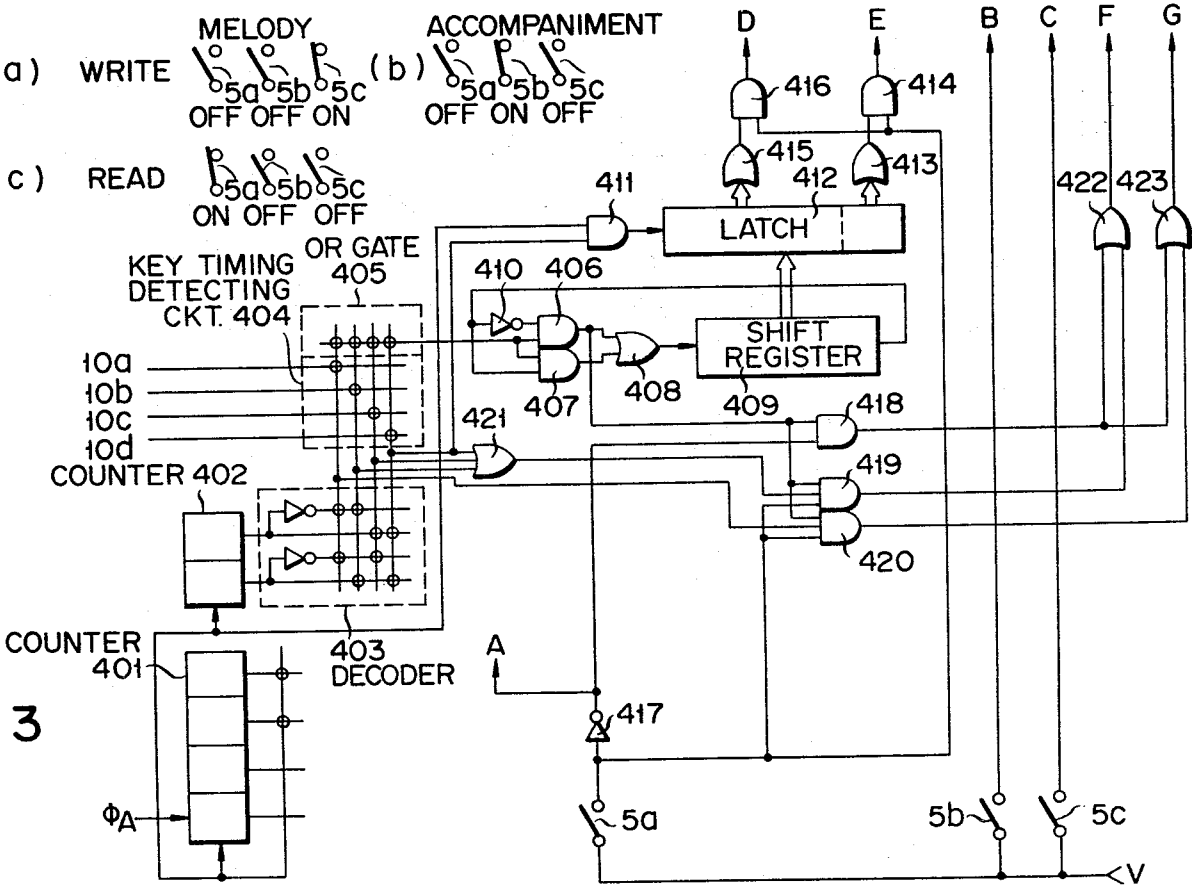
FIG. 3 is a circuit diagram, partly in block form, showing in detail the internal construction of a control section shown in FIG. 2C.
FIG. 4 is a view showing three different set positions of an operation mode selection switch unit.

The control section 40 receives the outputs from the switches 5*a*, 5*b* and 5*c* shown in FIG. 1, the outputs on the lines 10*a* to 10*d* of the key input section 10 and the clock signal $\phi_A$, and produces a gate on-off control signal A which is coupled to the other input terminals of the AND gates 61*a* to 61*d* in addition to the aforementioned control signals B to G. Its detailed construction is shown in FIG. 3.

As is shown, the control section 40 includes counters 401 and 402 having the same construction as the respective note counter 21 and the block counter 22 mentioned above. To the first bit of the counter 401 the clock signal $\phi_A$ for counting is supplied. When the content of this counter 21 becomes "12", a reset signal is coupled to the reset input terminal thereof. This reset signal is also coupled as a count clock signal to the block counter 402. The output of the counter 402 is coupled to a decoder 403 which has the same construction as the block decoder 24. The key operation signal output to the lines 10*a* to 10*d* is selectively coupled through a key timing detecting circuit 404 to an OR gate 405 according to the output of the decoder 403. Thus, bit timings peculiar to the individual keys are provided to the output of the OR gate 405. The key operation signal from the OR gate 405 is coupled to AND gates 406 and 407, the outputs of which are coupled through an OR gate 408 to a shift register 409 having a capacity of 48 bits. The output of the shift register 409 is coupled directly to the other input of the AND gate 407 and also coupled through an inverter 410 to the other input of the AND gate 406. Thus, the AND gate 406 produces output when a new key operation signal is coupled to it, while the AND gate 407 produces output when the same key operation signal is coupled to it.

The parallel output of the shift register 409 is transferred to a latch 412 when an output informing that the count of the counter 401 is "12" and that the count of the counter 402 is "3" is produced from an AND gate 411, i.e., when the scanning of all the keys is ended. The latch 412 supplies as the output of its lower 12 bits, i.e., bits for memorizing the key operation signal output to the line 10*a*, through an OR gate 413 and an AND gate 414 as on-off control signal E for the AND gates 31*e* to 31*h*, and also supplies as the output of the other bits through OR gate 415 and AND gate 416 as on-off control signal D for the AND gates 32*e* to 32*h*.

The output of the AND gate 406, which is produced as "1" signal when a new key is operated, is coupled to an AND gate 418 which also receives the output of an inverter 417 (i.e., control signal A) inverting the output of the switch 5*a*. To an AND gate 419 are coupled the output of the AND gate 406, the output of an OR gate 421 when the content of the counter 402 is "1", "2" or "3" and the output of the switch 5*a*, and to an AND gate 420 are coupled the output of the AND gate 406, the output of the decoder 403 when the content of the counter 402 is "0" and the output of the switch 5*a*. Of the outputs of the AND gates 418 to 420, the outputs of the AND gates 418 and 419 are coupled as increment signal F through the OR gate 422 to the second memory 32, while the outputs of the AND gates 418 and 420 are coupled as increment signal G through the OR gate 423 to the first memory 31.

The output of the switch 5*b* is supplied as signal B, i.e., on-off control signal for the AND gates 31*a* to 31*d* and R/W signal for the first memory 31, and the output of the switch 5*c* is supplied as signal C, i.e., on-off control signal for the AND gates 32*a* to 32*d* and R/W signal for the second memory 32.

Figure 5:
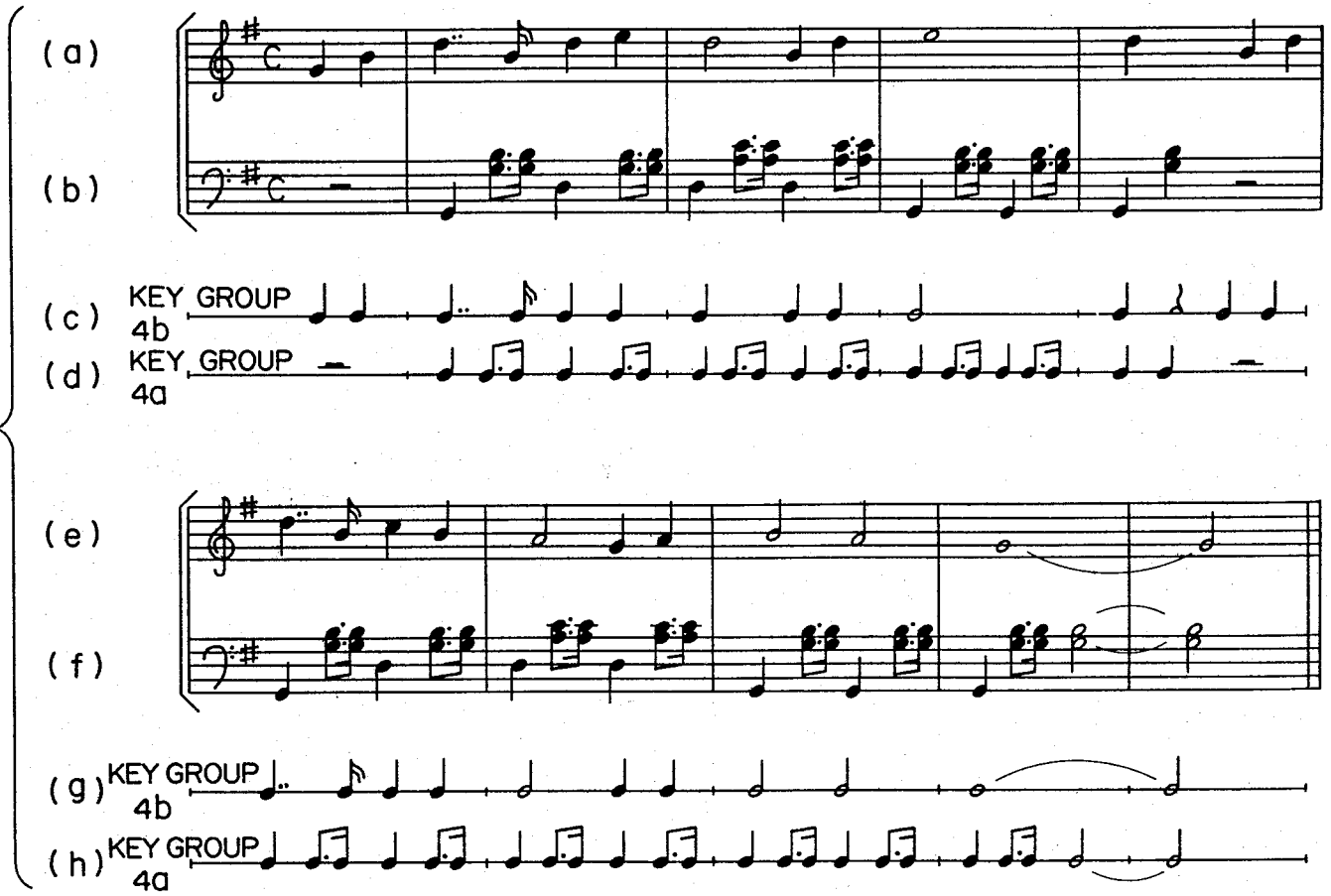
FIG. 5 is a view showing part of a musical score for illustrating the operation of the same embodiment.

The use of the electronic keyboard musical instrument having the above construction will now be described in connection with the case of previously writing a score as shown in FIG. 5 in the memories 31 and 32, more particularly the accompaniment score shown in (b) and (f) of FIG. 5 in the first memory 31 and the melody score shown in (a) and (e) of FIG. 5 in the second memory 32 and, in performance, reading out the accompaniment as shown in (d) and (h) by operating randomly selected keys in the first key group 4*a* and the melody as shown in (c) and (d) by operating randomly selected keys in the second key group 4*d* while designating the tone color by operating the switches 5*g* and 5*h*.

For writing the melody score shown in (a) and (e) in FIG. 5, the switches 5*a* and 5*b* are held "off" and the switch 5*c* "on" as shown in (a) in FIG. 4, and the keyboard 4 is operated to write the pitch codes of the score in the second memory 32. With the switch 5*c* held "on", the writing in the second memory 32 can be made. When the key 4-32 for $G_4$ in the keyboard 4 is operated for memorizing the first tone $G_4$, the resultant key operation signal, obtained on the line 10*c* at the note timing for G, is coupled through the AND gate 12*c*, which is held in the "on" state by the output from the switch 5*c*, to the second memory 32. The signal output to the line 10*c* is coupled through the OR gate 405 at a timing peculiar to $G_4$ to cause the AND gate 406 to produce output. Since the switch 5*a* is "off", the output of the AND gate 406 is coupled through the AND gate 418 and OR gate 422 and given as the increment signal F to the second memory 32, whereby the second memory 32 memorizes the present note code together with the block code provided through the AND gates 32*a* to 32*d*. The memory 32 (as well as the memory 31) is provided to count the appearances of the code for B from the note codes output to the lines 23*a* to 23*l* and memorizes all the codes coupled during the scanning of all the 48 keys for $C_2$ to $B_5$ as tones that are to be simultaneously produced. In the instant moment, it memorizes only the code for $G_4$. When the key 4-36 for $B_4$ is operated next, the code for this pitch $B_4$ is memorized in the manner as described above. In this way, the melody pattern as shown in (a) and (e) in FIG. 5 is preset in the memory 32 as the corresponding performance keys for the successive notes in the score, such as $D_5$, $B_4$, $D_5$, $E_5$, etc., are operated.

For writing the accompaniment score, the switches 5*a* and 5*c* are held "off" and the switch 5*b* "on" as shown in FIG. 4(*b*), and the keyboard 4 is set for writing. With the switch 5*b* held "on" the writing in the first memory 31 can be made. When the key 4-8 for the first tone $G_2$ is depressed as the first accompaniment sound, the resultant key operation signal, output to the line 10*a* at a note timing for G, is coupled through the AND gate 31*a* to the memory 31, and the note code at this time, output to the lines 23*a* to 23*l*, is coupled to the memory 31. At this time, the signal output to the line 10*a* is coupled through the OR gate 405 at a timing for $G_2$ to the AND gate 406, and the output thereof is coupled through the AND gate 418, which is in the "on" state since the switch 5*a* is "off", and the OR gate 423 to the memory 31 as increment signal G of writing instruction, whereby the note code output to the lines 23*a* to 23*l* and the block code output from the AND gates 31*a* to 31*d* are memorized in the memory 31. When the keys 4-20 and 4-24 for the respective tones $G_3$ and $B_3$ are simultaneously operated next, the codes for these tones $G_3$ and $B_3$ are memorized as sounds that are to be simultaneously produced. In this way, the accompaniment pattern as shown in (b) and (f) in FIG. 5 is preset in the memory 31 as the corresponding performance keys for the successive notes in the score, such as $G_3$ and $B_3$, $D_3$, $G_3$ and $B_3$, $G_3$ and $B_3$, etc., are operated.

Now, the case of performing the piece present in the first and second memories by considering only the rhythm pattern of the piece with keys in the second key group 4*b* randomly operated with a right hand finger for the melody and keys in the first key group 4*a* randomly operated with a left hand finger for the accompaniment will be described. In this case, the switch 5*a* is held "on" and the switches 5*b* and 5*c* "off", shown in (c) in FIG. 4. By this setting, AND gates 61*a* and 61*d* are held "off", that is, the first and second group keys 4*a* and 4*b* are respectively set as read-out keys for reading out the accompaniment and melody preset in the respective first and second memories 31 and 32.

At this time, the tone color for the accompaniment is set by operating the tone color designation switch 5*g*, and the tone color for the melody is set by operating the tone color designation switch 5*h*. The tone color designation switch 5*g* also serves to set the tone color in the ordinary performance.

In performance, for the first two tones of the melody part in the first bar of the piece shown in (a) and (b) in FIG. 5, which are without accompaniment, keys in the second key group 4*b* are arbitrarily operated with the right hand. The resultant output appearing on one of the lines 10*b* to 10*d* in the key input section 10 is not coupled through the AND gates 61*a* to 61*d* but is coupled through the OR gate 405, AND gates 406 and 419 and OR gate 422 to the second memory 32 as the increment signal F. With this signal input, the second memory 32 compares the note codes output to the lines 23*a* to 23*l* of the note decoder 23 and the preset note code G and, when the compared codes coincide, feeds out the coincident code through the AND gate 32*g* to the AND gate 25*g* according to the memorized block code (i.e., for the fourth octave since the instant note is $G_4$).

The output of the AND gate 406 is also coupled through the OR gate 408 to the shift register 409 and written therein, and the content of this shift register is transferred as parallel output to the latch 412. Since the data transferred to the latch 412 is for a key in the second key group 4*b*, the OR gate 415 produces an output which is coupled through the AND gate 416 to the AND gates 32*e* to 32*h* to turn on these AND gates.

Since the content memorized in the shift register 409 is recirculated through the AND gate 407, so long as the same key is being depressed, the signal is memorized in the same position and retained by the latch 412, so that during this period the same signal is continuously provided from the AND gate 416. Meanwhile, an octave detection signal is being coupled from the block decoder 24 through the line 24*c* to the AND gate 25*g*. Thus, when the line 24*c* is selected, that is, when the content of the block counter 22 becomes "2", the aforementioned key operation signal for $G_4$ is coupled through the AND gate 25*g* and OR gate 26*b* to the shift register 27*b* and then progressively shifted therethrough. Consequently, when the AND gates 28*c* produce an output, that is, when the scanning of all the keys in the key input section 10 is ended, the signal input to the shift register 27*b* is written in the buffer memory 28*b*, and according to the buffer memory data the tone generating circuit 29*b* produces a tone signal for the note $G_4$ including the tone color designation by the switch 5*h* and supplies it to the loudspeaker 6, whereby musical sound is produced therefrom.

When one of the keys in the second key group 4*b* is operated next for producing the second melody tone for the first bar, a tone signal for the note $B_4$ is produced in the tone generating circuit 29*b* in the manner as described and coupled to the loudspeaker 6 for sound production.

For the second bar, the first melody sound is reproduced by operating one of the keys in the second key group 4*b* with the right hand while the accompaniment is reproduced by operating one of the keys in the first key group 4*a* with the left hand. At this time, the melody sound based upon the key operation output from the second key group 4*b* is produced in the same manner as described above. Also, with the operation of a key in the first key group 4*a* the resultant key operation output is obtained in the line 10*a* and coupled through the OR gate 405, AND gates 406 and 420 and OR gate 423 to the first memory 31 as an increment signal G of reading instruction. With this instruction, the first memory 31 compares the note codes output to the lines 23*a* to 23*l* of the note decoder 23 with the preset note code and, when the coincidence of compared note codes is detected, feeds a "1" signal according to the memorized block code to one of the AND gates 31*e* to 31*h*. Since the tone that is memorized first for this bar is $G_2$, the memory 31 produces output when the note code for G is output to the lines 23*a* to 23*l*, and it is coupled through the AND gate 31*e* to the AND gate 25*a*. As a result, similar operation to that in the case of the reading from the second memory 32 takes place.

At this time, the key operation output on the line 10*a*, written in the shift register 409 and transferred to the latch 412, is coupled through the OR gate 413 and AND gate 414 to the AND gates 31*e* to 31*h* to cause reading operation similar to that from the second memory 32.

Thus, in the tone generating circuit 29, a tone signal for the note code for $G_2$ read out from the first memory 31 and a tone signal for the note code for $D_5$ read out from the second memory 32, containing respective tone color designations by the switches 5*g* and 5*h*, are simultaneously produced and coupled to the loudspeaker 6 for sound production.

In the above way, by operating, with the rhythm shown in the rhythm scores of FIGS. 5(*c*), (*g*), arbitrary keys in the second key group 4*b* with the right hand according to the melody score shown in (a) and (e) in FIG. 5 while operating, with the rhythm shown in the rhythm scores of FIGS. 5(*d*), (*h*), arbitrary keys in the first key group 4*a* with the left hand according to the accompaniment score shown in (b) and (f) in FIG. 5, successive tone signals are produced in the tone generating circuit 29 according to the score as shown in FIG. 5 and coupled to the loudspeaker 6 for sound production.

While in the above embodiment the keyboard 4 has been divided into a first key group 4*a* for one octave and a second key group 4*b* for three octaves, this is by no means limitative, and it is possible to change the intervals of the divisions as desired. Also, it is possible to divide the keyboard into three or more groups and provide memories for the respective groups so as to permit reading of the contents of these memories while changing the color of the produced musical sound for the individual key groups. Further, it is possible to permit division of the keyboard at desired positions by the provision of a setting means operable by the player for setting the intervals of divisions as desired.

Still further, while in the above embodiment plural memories have been provided for respective keys groups and read out with the operation thereof for performance, it is possible to permit note or pitch codes to be written in a single memory by operating the keyboard and read out from the memory with the operation of keys with different colors of the output musical sound designated for individual key groups.

Further, the method of designation of the colors of the output musical sound in the above embodiment is not limitative. Also, the invention is of course applicable to electronic keyboard musical instruments making use of draw bars or tablets for designating tone colors as well. In general, it is only necessary that the tone color designation for the musical sound reproduction be controlled for each of preset key groups.

Further, while in the above embodiment all the keys in the keyboard have been set as the read-out designation keys in the case of the performance by reading preset performance data, some of the keys may be operable as manual performance keys even in this case.

Further, while in the above embodiment the performance data of the melody and accompaniment of a piece have been previously written in the memories 31 and 32 by operating the keyboard and read out for reproduction performance by operating preset group keys of the keyboard, it is also possible to arrange such that performance data of a piece of music stored in memory means such as magnetic cards, magnetic tapes, random access memories (RAM), packages or bar codes may be transferred to and written in the memories 31 and 32 and read out for reproduction performance by operating designated performance keys.

Further, as the memory which memorizes the performance data of a piece and permits the reading of the data with the key operation, various memories such as digital magnetic tapes may be used as well as semiconductor memories such as RAM.

Further various changes and modifications are possible without departing from the scope and spirit of the invention.

As has been shown, since the electronic keyboard musical instrument according to the invention is adapted such that pitch codes of a music piece previously recorded can be read out with the operation of keys for reproduction of the music sound with the sound colors designated for the read-out designation key groups, it is possible to obtain reproduction of performance with different sound colors provided for the melody and accompaniment respectively, and also it is readily possible to change the sound color during the reproduction performance. Thus, it is possible to provide various sound effects to the reproduction performance. In addition, even considerably difficult pieces can be produced by reproduction performance according to the rhythm pattern, which is very useful for beginners.

What is claimed is:

1. An electronic keyboard musical instrument comprising:

a keyboard having a plurality of performance keys, each of said performance keys being associated with a musical tone of a given pitch;

memory means for storing successive musical pitch codes in successive address areas, said successive musical pitch codes representing a musical piece;

control means coupled to said keyboard and including:

function setting means for dividing said performance keys of said keyboard in a plurality of groups as pitch code reading instruction keys; and means coupled to said function setting means for addressing said memory means successively in accordance with operations of said performance keys set as said pitch code reading instruction keys so as to read out the successive musical pitch codes from said memory means;

tone color setting means coupled to said control means for setting different tone colors for tones to be generated by the operations of respective groups of pitch code reading instruction keys; and tone generating means coupled to said control means and to said tone color setting means for generating tones having tone colors set by said tone color setting means, and pitches of said generated tones being determined by the read-out successive musical pitch codes, and not by the pitches of the operated pitch code reading instruction keys.

2. The electronic keyboard musical instrument of claim 1, wherein:

said plurality of performance keys of said keyboard are divided into a first key group comprising keys in a low octave section and a second key group comprising the other keys; and said memory means includes a first memory for storing the pitch codes of the accompaniment of a musical piece being read out with the operation of said first key group and a second memory for storing the pitch codes of the melody of the musical piece being read out with the operation of the said second key group.

3. The electronic keyboard musical instrument of claim 1, wherein said memory means includes means for storing pitch codes of the musical piece supplied from an external input means.

4. The electronic keyboard musical instrument of claim 2, wherein said function setting means includes a function switch having a plurality of contacts and which is settable at first, second and third set positions for permitting writing of the content of performance with the operation of performance keys in said first memory in said first set position of said function switch, writing the content of performance with the operation of performance keys in said second memory in said second set position of said function switch, and reading of pitch codes written in said first and second memories with the operation of performance keys respectively belonging to first and second groups for reproduction of recorded sounds with different tone colors provided for the individual groups in said third set position of said function switch.

5. The electronic keyboard musical instrument of claim 4, wherein said memory means includes means for storing pitch codes of the musical piece supplied from an external input means.

6. The electronic keyboard musical instrument of claim 4, wherein:

said tone color setting means includes first and second tone color setting switches; and said tone generating means includes:

first tone generating means coupled to said first tone color setting switch for producing a first tone signal according to pitch code read out from said first memory, said first tone signal having a first tone color designated by said first tone color setting switch; and second tone generating means coupled to said second tone color setting switch for producing a second tone signal according to a pitch code read out from said second memory, said second tone signal having a second tone color designated by said second tone color setting switch.

7. The electronic keyboard musical instrument of claim 2, wherein:

said tone color setting means includes first and second tone color setting switches; and said tone generating means includes:

first tone generating means coupled to said first tone color setting switch for producing a first tone signal according to pitch code read out from said first memory, said first tone signal having a first tone color designated by said first tone color setting switch; and second tone generating means coupled to said second tone color setting switch for producing a second tone signal according to a pitch code read out from said second memory, said second tone signal having a second tone color designated by said second tone color setting switch.

8. An electronic keyboard musical instrument comprising:

a keyboard having a plurality of performance keys, each of said performance keys being associated with a musical tone of given pitch;

function setting means for dividing said performance keys of said keyboard in a plurality of groups as pitch code reading instruction keys;

a plurality of memory means, each memory means storing successive musical pitch codes in successive address areas, said successive musical pitch codes representing a musical piece;

addressing means coupled to said function setting means and to said keyboard, for addressing said respective memory means in accordance with operations of respective groups of pitch code reading instruction keys;

tone color setting means coupled to said function setting means for setting different tone colors for tones to be generated by the operations of respective groups of pitch code reading instruction keys; and tone generating means coupled to said addressing means and to said tone color setting means for generating tones having tone colors set by said tone color setting means, and the pitches of said generated tones being determined.

9. The electronic keyboard musical instrument of claim 8, wherein:

said plurality of performance keys of said keyboard are divided into a first key group comprising keys in a low octave section and a second key group comprising the other keys; and said plurality of memory means include a first memory means for storing the pitch codes of the accompaniment of a musical piece being read out with the operation of said first key group and a second memory means for storing the pitch codes of the melody of the musical piece being read out with the operation of the said second key group.

10. The electronic keyboard musical instrument of claim 9, wherein said function setting means includes a function switch having a plurality of contacts and which is settable at first, second or third set positions to permit writing of the content of performance with the operation of performance keys in said first memory means in said first set position of said function switch, writing the content of performance with the operation of performance keys in said second memory means in said second set position of said function switch, and reading of pitch codes written in said first and second memory means with the operation of performance keys respectively belonging to first and second groups for reproduction of recorded sounds with different tone colors provided for the individual groups in said third set position of said function switch.

11. The electronic keyboard musical instrument of claim 9, wherein:

said tone color setting means include first and second tone color setting switches; and said tone generating means includes:

first tone generating means coupled to said first tone color setting switch for producing a first tone signal according to a pitch code read out from said first memory means, said first tone signal having a first tone color designated by said first tone color setting switch; and second tone generating means coupled to said second tone color setting switch for producing a second tone signal according to a pitch code read out from said second memory means, said second tone signal having a second tone color designated by said second tone color setting switch.

12. An electronic keyboard musical instrument comprising:

a keyboard having a plurality of performance keys, said plurality of performance keys being divided into a first key group comprising keys in lower pitch section and a second key group comprising keys in higher pitch section;

first memory means for storing pitch codes of the accompaniment of a musical piece in successive address areas, said pitch codes being read out with the operation of said first key group;

second memory means for storing pitch codes of the melody of the musical piece in successive address areas, said pitch codes being read out with the operation of said second key group;

tone color setting means for setting different tone colors for tones to be generated by the operations of respective key groups;

first tone generating means coupled to said first memory means and to said tone color setting means, for producing a first tone signal having a first tone color designated by said tone color setting means and the pitch of said first tone signal being determined by the read-out successive musical pitch code, and not by the pitch code of the operated pitch code reading instruction keys; and second tone generating means coupled to said second memory means and to said tone color setting means, for producing a second tone signal having a second tone color designated by said tone color setting means, and the pitch of said second tone signal being determined by the read-out successive musical pitch code, and not by the pitch of the operated pitch code reading instruction keys.

13. An electronic keyboard musical instrument comprising:

a keyboard having a plurality of performance keys, each of said performance keys being associated with a musical tone of a given pitch;

memory means for storing successive musical pitch codes;

control means coupled to said keyboard including:

function setting means for dividing said performance keys of said keyboard in a plurality of groups as pitch code reading instruction keys; and means coupled to said function setting means for addressing said memory means successively in accordance with operations of said performance keys set as said pitch code reading instruction keys so as to read out the successive musical pitch codes from said memory means;

tone color setting means coupled to said control means for setting different tone colors for respective groups of pitch code reading instruction keys; and tone generating means coupled to said control means and to said tone color setting means for generating tones having pitches corresponding to the read-out successive musical pitch codes and having tone colors set by said tone color setting means;

said plurality of performance keys of said keyboard being divided into a first key group comprising keys in a low octave section and a second key group comprising the other keys;

said memory means including a first memory for storing the pitch codes of the accompaniment of a musical piece being read out with the operation of said first key group and a second memory for storing the pitch codes of the melody of the musical piece being read out with the operation of the said second key group; and said function setting means including a function switch having a plurality of contacts and which is settable at first, second and third set positions for permitting writing of the content of performance with the operation of performance keys in said first memory in said first set position of said function switch, writing the content of performance with the operation of performance keys in said second memory in said second set position of said function switch, and reading of pitch codes written in said first and second memories with the operation of performance keys respectively belonging to first and second groups for reproduction of recorded sounds with different tone colors provided for the individual groups in said third set position of said function switch.

14. The electronic keyboard musical instrument of claim 13, wherein said memory means includes means for storing pitch codes of the musical piece supplied from an external input means.

15. The electronic keyboard musical instrument of claim 13, wherein:

said tone color setting means includes first and second tone color setting switches; and said tone generating means includes:

first tone generating means coupled to said first tone color setting switch for producing a first tone signal according to pitch code read out from said first memory, said first tone signal having a first tone color designated by said first tone color setting switch; and second tone generating means coupled to said second tone color setting switch for producing a second tone signal according to a pitch code read out from said second memory, said second tone signal having a second tone color designated by said second tone color setting switch.

16. An electronic keyboard musical instrument comprising:

a keyboard having a plurality of performance keys, each of said performance keys being associated with a musical tone of given pitch;

function setting means for dividing said performance keys of said keyboard in a plurality of groups as pitch code reading instruction keys;

a plurality of memory means, each memory means storing successive musical pitch codes;

addressing means coupled to said function setting means and to said keyboard, for addressing said respective memory means in accordance with operations of respective groups of pitch code reading instruction keys;

tone color setting means coupled to said function setting means for setting different tone colors for respective groups of pitch code reading instruction keys; and tone generating means coupled to said addressing means and to said tone color setting means for generating tones having pitches corresponding to the read-out successive musical pitch codes and having tone colors set by said tone color setting means;

said plurality of performance keys of said keyboard being divided into a first key group comprising keys in a low octave section and a second key group comprising the other keys;

said plurality of memory means including a first memory means for storing the pitch codes of the accompaniment of a musical piece being read out with the operation of said first key group and a second memory means for storing the pitch codes of the melody of the musical piece being read out with the operation of the said second key group; and said function setting means includes a function switch having a plurality of contacts and which is settable at first, second or third set positions to permit writing of the content of performance with the operation of performance keys in said first memory means in said first set position of said function switch, writing the content of performance with the operation of performance keys in said second memory means in said second set position of said function switch, and reading of pitch codes written in said first and second memory means with the operation of performance keys respectively belonging to first and second groups for reproduction of recorded sounds with different tone colors provided for the individual groups in said third set position of said function switch.

* * * * *